US005443110A

United States Patent [19]

Plott, Sr.

[11] Patent Number: 5,443,110

[45] Date of Patent: Aug. 22, 1995

[54] PROTECTIVE DEVICE FOR WINDOW OPENINGS

[76] Inventor: John F. Plott, Sr., 2715 Foxianna Rd., Middletown, Pa. 17057

[21] Appl. No.: 122,289

[22] Filed: Sep. 17, 1993

[51] Int. Cl.[6] ..... A62B 1/22

[52] U.S. Cl. ..... 160/368.1; 52/37; 52/208

[58] Field of Search ..... 160/368.1, 354, 327; 52/37, 202, 208; 49/50, 57; 182/138; 24/625

[56] References Cited

U.S. PATENT DOCUMENTS

| | | | |
|---|---|---|---|
| 673,703 | 5/1901 | Davis et al. | 160/368.1 X |
| 936,041 | 10/1909 | Rush | 49/57 |
| 980,789 | 1/1911 | Jeffery | 160/368.1 X |
| 2,136,042 | 11/1938 | Cornell et al. | 160/327 |
| 2,246,663 | 6/1941 | Bradshaw | 160/368.1 X |
| 3,692,327 | 9/1972 | Barrick, Sr. et al. | 280/150 B |
| 4,712,280 | 12/1987 | Fildan | 24/625 |
| 4,773,802 | 9/1988 | Rewis | 160/368.1 X |
| 4,825,515 | 5/1989 | Wolterstorff | 24/625 |
| 4,924,814 | 5/1990 | Beaudet | 119/96 |
| 4,993,187 | 2/1991 | Schweiss et al. | 49/56 |
| 5,056,262 | 10/1991 | Schweiss et al. | 49/56 |
| 5,144,725 | 9/1992 | Krauss | 24/625 |
| 5,148,582 | 9/1992 | Dennis | 24/625 |
| 5,222,279 | 6/1993 | Frano et al. | 24/625 |
| 5,290,086 | 3/1994 | Tucker | 296/152 |
| 5,309,610 | 5/1994 | le Gal | 24/625 |

*Primary Examiner*—Carl D. Friedman
*Assistant Examiner*—Robert J. Canfield
*Attorney, Agent, or Firm*—John P. Halvonik

[57] ABSTRACT

The invention is a system for attaching a protective netting over windows. A main netting portion is made of nylon mesh and reinforced along its edges with nylon portions in the form of straps. Screws or other means of secure attachment are used to secure the bottom edge of the main portion to the area below the window. The screws are placed through in the strap that reinforces the bottom edge. A pair of upper straps secure the upper portion of the netting to the area above the window. Each strap is in connection with a clip that is secured to an eyelet on the wall of the building. Other means for connection of the upper straps are disclosed.

1 Claim, 1 Drawing Sheet

PROTECTIVE DEVICE FOR WINDOW OPENINGS

BACKGROUND OF THE INVENTION

The invention relates to the field of protective devices and in particular to a netting and supporting features that are used to support a netting over a window opening. Many times small children have been found to have fallen out of open windows. Oftentimes, such windows are in large high rise buildings and of course the consequences of falling out of a window in such a building can be fatal. It is believed that many children may be saved by placing a protective netting over the window to allow air and light to pass through while preventing children from falling out.

Such a protective netting should have some means to allow the netting to be removed in the event of fire or other emergency that mandates that the occupants leave the house or building through the window. By using readily detachable clips that are in turn secured to the wall of the building, a secure means may be had for attaching the upper part of the netting to the building and still allowing this part to be removed by an adult in case of emergency. It is not believed that small children will be able to reach up to this area where the upper straps are secured and also that they will not understand how to undo the clips. Thus, the upper portions will not be readily detachable by a child.

DESCRIPTION OF THE PRIOR ART

While there are protective devices used to keep workmen etc. from falling off of buildings, there are no devices known to the applicant that protect people from falling out of windows.

SUMMARY OF THE INVENTION

The invention is a system for supporting a netting over an otherwise open window to protect small children as well as other people from falling out of windows. A main netting portion is preferably made of a rather fine nylon mesh and is reinforced along its edges with nylon straps. Screws are used to secure the bottom edge of the netting to the area below the window. The screws are placed through eyelets in the strap that reinforces the bottom edge. A pair of upper straps secure the upper portion of the netting to the area above the window. Each strap is in connection with a readily detachable clip or other such means that is secured to an eyelet on the wall of the building.

It is an object of the invention to provide a protective netting over a window to prevent children as well as other people from falling out of open windows.

Another object of the invention is to provide a protective netting over open windows that may easily be opened in the event the occupants of the building need to get out through the window.

Another object of the invention is to provide a protective netting for windows that will be of small enough mesh to prevent children from placing their hands through the netting.

Other objectives of the invention will become apparent to those skilled in the art once the invention has been shown and described.

DESCRIPTION OF THE PREFERRED EMBODIMENT

Figure 1:
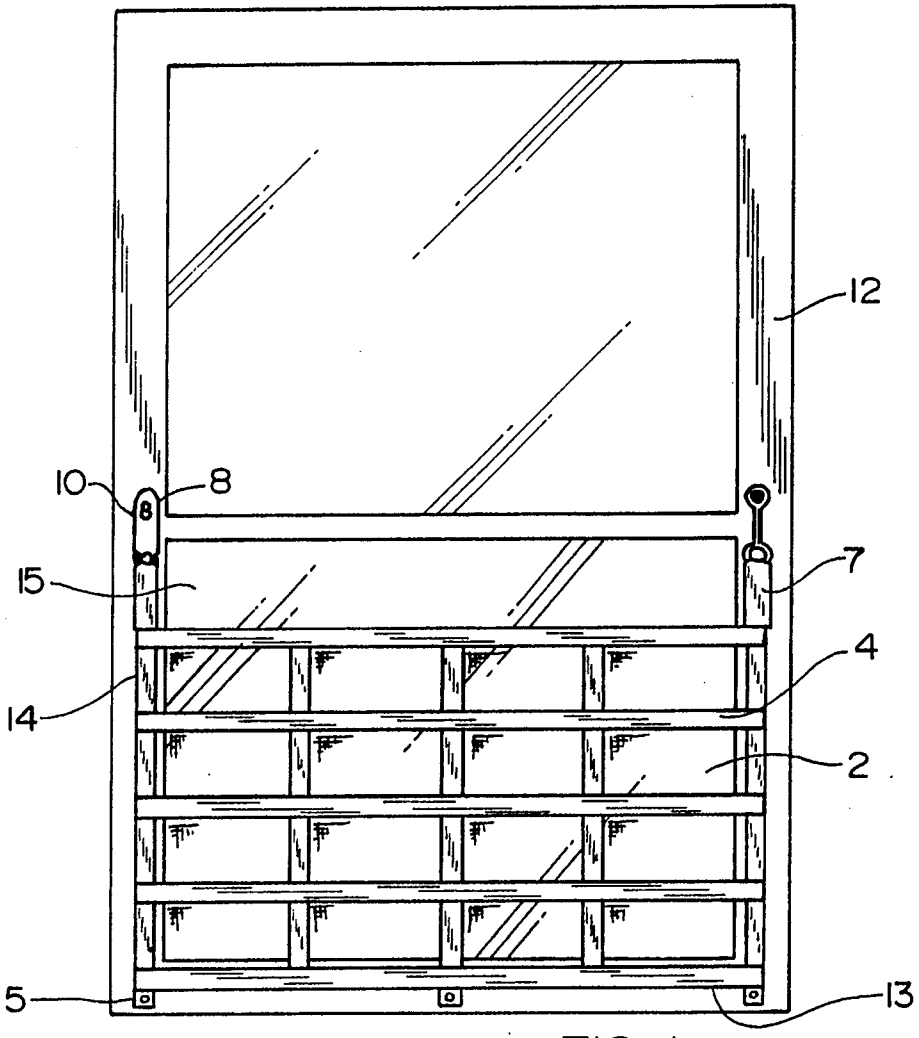
FIG. 1 Overall construction of the apparatus.

The overall construction of the apparatus is as shown in FIG. 1. The main netting portion (2, 4, 13, 14) is of generally rectangular shape in order to conform to the dimensions of most windows. The size of the netting may vary depending on the size of the window that is to be covered.

It is preferred that the netting be made of a thin nylon mesh 2 and that the outer edges of the main portion be nylon straps 4, 13, 14 which serve to reinforce the edges of the netting. The straps may also cross the netting in gridiron fashion to further reinforce the netting. It is thought that the use of a rather small mesh will prevent things from getting caught in the netting which may otherwise lead to small children having their attention drawn to the netting.

The upper portion of the netting should be secured to the frame 12 of the window by sturdy and relatively easy to open means such as clips 10 in case the occupants need to exit through the window in the case of fire, etc. Those members 5 used to secure the bottom of the netting are referred to as the lower securing means and those used to secure the top of the netting are called the upper securing means.

The bottom edge of the netting should be attached closely to the area around the bottom of the window. The netting, in other words, should be flush with the surface of the window frame (or the wall) or as flush as possible. The bottom edge is preferably secured with screws 5 that are placed through reinforced eyelets in the bottom edge 13 of the netting (or in small straps in close connection with the bottom edge) and then into the wall or frame.

The eyelets may be reinforced with e.g. metal washers and may be placed in the nylon strap 13 that goes along the bottom edge. Eyelets are used to prevent wear and tear on the netting. The use of the screws allows the netting to be closely secured to the area beneath the window by screwing the netting tightly to the wood or other material found there. These lower securing means are not meant to be readily detachable-in contrast to the upper means which are meant to be readily detachable by an adult in the event of emergency.

The netting may be emplaced by first attaching the lower securing means i.e. the aperture is drilled into the wall of the building in the window frame area. The lower portion is then secured by the screws 5 placed in through the eyelets and screwed into place. The upper straps 7 are then attached to e.g. dog clips 10 that are connected to eyelets 8 already in place in the frame or wall.

The upper securing members (8, 10) of the netting should be secured to the area around the window in a manner that allows it to be easily released in case of emergency. A pair of upper straps 7 of nylon or other material may be used to connect the upper edge of the netting to the clips. "Upper" is used to distinguish these straps from those that are used to reinforce the edges of the netting. The two upper straps 7 are connected at one end to a strap 14 bordering the upper edge of the netting. At the other end, the straps are attached to detachable clips e.g dog clips 10 shown in FIG. 1. Such clips should be relatively easy for adults to use and relatively difficult for infants (e.g. 6 years of age and younger) to undo.

The upper straps 7 should be at least 18″ in height so that they may be attached to the frame or wall at a point (roughly analogous to 8) some distance above the lower window pane 15 so that they will be out of the reach of small children. In this manner, the straps will be difficult for a child to remove as the upper securing means would then also be 18″ above the window.

The eyelets and the dog clips means may be made of any rigid materials. Probably steel and other metals would be useful in this regard. There can be any number of lower and upper attaching means. It is thought that two upper straps would be preferred but more can be used.

Figure 2:
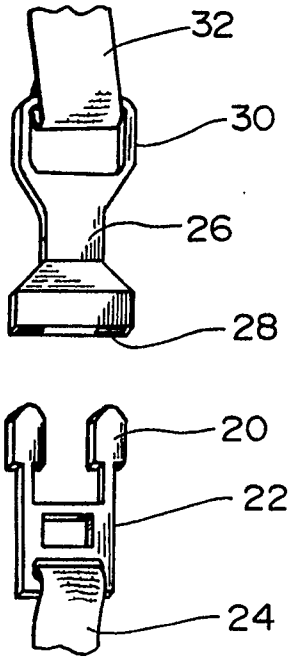
FIG. 2 Optional clip.

An alternate type of clip that may find use for the upper attaching means is known as an adjustable release buckle, see FIG. 2. One portion 22 has two projecting ends 20 that are slightly pointed so that they may be inserted into a second portion 26 having an opening 28 for the first. The projecting ends may be flexed left or right by squeezing on their sides. To attach the two portions to one another, the portion 22 is inserted into 26, the projecting portions flex inward as they are inserted and then flex outward as they lock into place they will be inserted through the opening 28 and remain in place with each projecting member at one side of 26. This locks them into place.

To separate the two members, the projecting portions are squeezed (when locked these portions are found at either side of 26) to release them from 26. If the sides are not squeezed the insertion end cannot be removed and the strap cannot be released. It is believed that this sort of action will prevent infants and small children from detaching the upper straps from the frame or wall. Other types of clips may also be used without violating the spirit of the invention.

I claim:

1. A safety apparatus for attachment to the outside of the wall of a building in order to cover an open window with a protective netting, said apparatus comprising: a netting portion having top, bottom and two side edges, said bottom edge in connection with a means for securing said edge to said wall, said netting portion each in connection with a pair of straps, each of said straps in connection with a two part releasing means comprising a first and second part each, said first part having a base and a pair of extended portions in connection with said base, each of said extended portions having a tongue portion in connection with said extended portion, said extended portions made of resilient material so that said extended portions may be squeezed toward one another, each said second part comprising a middle section and two conduits in connection with said middle section and at opposite sides of said middle section, said conduits having front openings and rear openings and of shape adapted to fit said tongue portions so that said tongue portions may be secured within said conduits by insertion, each said first part of said releasing means in connection with one of said straps, said second part of said releasing means in connection with a means for securing each said second part to said wall.

* * * * *